United States Patent [19]

Takimoto et al.

[11] Patent Number: 4,991,347

[45] Date of Patent: Feb. 12, 1991

[54] OPENING/CLOSING MECHANISM FOR THE USE IN CIRCULAR-ARC SHAPED SLIDING DOORS

[75] Inventors: Akiyoshi Takimoto; Kenzo Ono; Yuichi Noguchi, all of Toyama, Japan

[73] Assignee: Yoshida Kogyo K. K., Tokyo, Japan

[21] Appl. No.: 530,478

[22] Filed: May 29, 1990

Related U.S. Application Data

[63] Continuation of Ser. No. 398,994, Aug. 28, 1989 abandoned.

[30] Foreign Application Priority Data

Sep. 1, 1988 [JP] Japan ..... 63-216396
Sep. 1, 1988 [JP] Japan ..... 63-114034

[51] Int. Cl.[5] ..... E06B 3/34

[52] U.S. Cl. ..... 49/40; 49/118; 49/123; 49/370; 474/200

[58] Field of Search ..... 49/40, 116–118, 49/123, 362, 370; 474/101, 102, 112, 121, 153, 159, 200

[56] References Cited

U.S. PATENT DOCUMENTS 3,995,506 12/1976 Poe ..... 474/200
4,050,191 9/1977 Azuma ..... 49/123 X
4,259,810 4/1981 West ..... 49/123 X
4,785,579 11/1988 Sugiyama ..... 49/118 X

FOREIGN PATENT DOCUMENTS 62-187078 11/1987 Japan .
2202258 9/1988 United Kingdom .

*Primary Examiner*—Gary L. Smith
*Assistant Examiner*—Jerry Redman
*Attorney, Agent, or Firm*—Hill, Van Sante, Steadman & Simpson

[57] ABSTRACT

An opening/closing mechanism for use in a circular-arc shaped sliding door including a transverse frame having a circular-arc horizontal sectional shape and mounted on the upper parts of a pair of left and right door bodies; a drive pulley and a driven pulley mounted on the circumferentially one end of the transverse frame and on the other end thereof, respectively; and an endless belt wound between and around the drive pulley and a driven pulley, the pair of door bodies being connected in place to the endless belt so that they may be slidably moved in opposite directions to each other along a pair of left and right guide rails, respectively, each of which is bent in a circular-arc shape concentric with the center of the circular-arc of the transverse door frame.

8 Claims, 11 Drawing Sheets

OPENING/CLOSING MECHANISM FOR THE USE IN CIRCULAR-ARC SHAPED SLIDING DOORS

This is a continuation of application Ser. No. 398,994, filed Aug. 28, 1989, now abandoned.

BACKGROUND OF THE INVENTION

1. Field of the Invention

This invention relates to an opening/closing mechanism for use in a double-sliding door having a circular-arc sectional shape in a horizontal plane and arranged to be closed at a central abutting position (which is referred to hereinbelow simply as "circular-arc shaped sliding door"), and more particularly to an opening/-closing mechanism for use in a circular-arc shaped sliding door including a transverse frame having a circular-arc horizontal sectional shape and mounted on the upper parts of a pair of left and right door bodies; a drive pulley and a driven pulley mounted on the one circumferential end of the transverse frame and on the other end thereof, respectively; and an endless belt wound between and around the drive pulley and a driven pulley, the pair of door bodies being connected in place to the endless belt so that they may be slidably moved in opposite direction with each other.

2. Disclosure of Prior Art

A prior art opening/closing mechanism for use in a circular-arc shaped sliding door is known, for example, from Japanese Utility Model Application Laid-Open Specification No. SHO-62-187078.

Stating in brief, this opening/closing mechanism for use in a circular-arc shaped sliding door is arranged such that, as shown in FIG. 1, each of a pair of door bodies 1, 1 having a circular-arc horizontal sectional shape can be moved along each of guide rails (not shown) each having a circular-arc horizontal sectional shape; a pair of endless belts 2, 2 are arranged in respective loops in their respective horizontal planes along their respective guide rails; each of the endless belts 2 is connected to each of the door bodies 1; a drive pulley 3 for one of the endless belts 2 is connected to a motor 4, and driven pulleys 5 and 6 are mounted adjacent to each other so that a gear 7 coupled concentrically with the driven pulley 5 can mesh with a gear 8 coupled concentrically with the driven pulley 6, the arrangement being made such that when the motor is driven the pair of endless belts 2, 2 are turned in opposite directions relative to each other so that the pair of door bodies 1, 1 may be moved either in the opening direction or in the closing direction to thereby open or close the door.

In such an opening/closing mechanism, the pair of door bodies 1, 1 can be moved by means of one set of motors 4, however, provision of a pair of endless belts 2, 2 is required to move the pair of door bodies 1, 1, respectively, and also interlocking of the gears 7, 8 is required to enable the pair of endless belts 2, 2 to be turned synchronously at the same speed. If changes in backlash between the gears 7 and 8 or changes in the lengths of the pair of endless belts 2, 2 occur, then it becomes sometimes impossible to move the pair of door bodies 1, 1 synchronously at the same speed, thereby making it impossible to ensure that the circular-arc shaped sliding door can be opened and closed satisfactorily.

Further, in the above-mentioned prior art opening/closing mechanism, since each of the endless belts 2, 2 is wound between and around the pulleys located at both ends and bent in a circular-arc shape in a horizontal plane along the moving locus defined by the door body 1, it is necessary to arrange the mechanism such that inner guide rollers 9*a* are kept in contact with the outer surface 2*a* of the endless belt 2 and outer guide rollers 9*b* are kept in contact with the inner surface 2*b* thereof.

To cope with this, if a toothed belt is used as the endless belt 2 to prevent the belt from slipping relative to the pulley, then, because the outer guide rollers 9*b* are kept in contact with the teeth formed on the endless belt 2, it is necessary to use toothed rollers as the outer guide rollers 9*b* to enable the endless belt 2 to be guided smoothly. However, the use of toothed rollers as the outer guide rollers 9*b* entails a disadvantage in that noise is generated when the toothed rollers are engaged with and disengaged from the tooth on the endless belt, and because of provision of a plurality of outer guide rollers 9*b*, the level of the noise which occurs when the circular arc shaped door is opened or closed becomes high.

SUMMARY OF THE INVENTION

The present invention has been made in view of the above-mentioned circumstances in the prior art, and has for its object to provide an opening/closing mechanism for use in a circular-arc shaped sliding door arranged such that a pair of door bodies can be moved either in the opening direction or in the closing direction by means of a single endless belt.

Another object of the present invention is to provide an opening/closing mechanism for use in a circular-arc shaped sliding door arranged such that there is no need for using toothed rollers as the outer guide rollers.

To achieve the above-mentioned objects, according to the first aspect of the present invention, there is provided an opening/closing mechanism for use in a double-sliding type circular-arc shaped door including a pair of left and right door bodies each having a circular-arc horizontal sectional shape, and a transverse door frame having a circular-arc horizontal sectional shape which is mounted on the door bodies, the arrangement being made such that the door can be opened and closed by slidably moving said door bodies, respectively, under the transverse frame, in opposite directions with each other relative to a door's abutment line, which passes through the circumferentially central part of the transferse frame and the center of the circular-arc of guide rails for guiding the door bodies, respectively, in such a way as to generate circular-arc shaped moving loci, respectively, said mechanism comprising: a drive pulley and a driven pulley mounted on the one circumferential side end of the transverse frame and on the other side end thereof, respectively; an endless belt wound between and around the drive pulley and the driven pulley so that one of inner circular-arc shaped portions of the belt on the side and one of outer circular-arc shaped portions thereof on the other side, which are defined, respectively, relative to the door's abutment line, may be moved in such a way as to generate circular-arc shaped loci having equal radius to each other and each of the loci being concentric with the center of the moving locus defined by each of the door bodies; and inner and outer guide means arranged so as to be kept in contact with the outer surfaces of the inner circular-arc shaped portions of the endless belt and the inner surfaces of the outer circular-arc shaped portions thereof, respectively, wherein one of the pair of door bodies is connected to one of the inner circular-arc shaped portions of the endless belt on one side, whilst another door body is connected to one of the outer circular-arc shaped portions of the endless belt on the other side, To achieve the above-mentioned objects, according to the second aspect of the present invention, there is provided an opening/closing mechanism for use in a circular-arc shaped sliding door as set forth in the first aspect, characterized in that both the drive pulley and the driven pulley are toothed pulleys, and the endless belt wound between and around these toothed pulleys is also a toothed belt, and that the toothed endless belt is twisted by an angle of 180 degrees in the vicinity of turning end portions from which, during the movement of said belt, one of inner circular-arc shaped portions of said belt on one side thereof is turned into the outer circular-arc shaped portion, while one of outer circular-arc shaped portions thereof on the other side is turned into the inner circular-arc portion, so that, over the major part of the outer circular-arc shaped portions on both sides, the inner surface of the belt having teeth formed thereon adapted to be originally turned inside may be turned outside, whilst the smooth outer surface of the belt adapted to be originally turned outside may be turned inside, and that the outer guide means are arranged to be kept in contact with the inwardly turned smooth outer surfaces of the outer circular-arc shaped portions of the belt, whilst the inner guide means are arranged so as to be kept in contact with the inwardly smooth outer surfaces of the inner circular-arc shaped portions of the belt.

Accordingly to the third aspect of the present invention, there is provided an opening/closing mechanism for use in a circular-arc sliding shaped door as set forth in the first aspect, characterized in that said inner and outer guide means are strips each having a circular-arc shape concentric with the center of the circular-arc of the transverse door frame.

According to the fourth aspect of the present invention, there is provided an opening/closing mechanism for use in a circular-arc shaped sliding door as set forth in the first aspect, characterized in that each of said inner and outer guide means is a plurality of rollers arranged at regular intervals with one another along a circular-arc concentric with the center of the circular arc of the transverse door frame.

According to the fifth aspect of the present invention, there is provided an opening/closing mechanism for use in a circular-arc shaped sliding door as set forth in the first aspect, characterized in that the pair of door bodies are arranged to be moved in opposite directions with each other along a pair of left and right guide rails, respectively, each of which is bent in a circular-arc shape concentric with the center of the circular-arc of the transverse door frame.

According to the sixth aspect of the present invention, there is provided an opening/closing mechanism for use in a circular-arc shaped sliding door as set forth in the first aspect, characterized in that the driven pulley has a diameter equal to that of the drive pulley, and the center of the driven pulley is located closer to the center of the circular-arc of the guide rails than the center of the circular-arc of the drive pulley relative to that of the guide rails by a distance corresponding to the diameter of the driven pulley so that the radius of the circular-arc shaped moving locus defined by the inner circular-arc shaped portion of the endless belt on one side may become substantially equal to that of the circular-arc shaped moving locus defined by the outer circular-arc shaped portion thereof on the other side.

According to the seventh aspect of the present invention, there is provided an opening/closing mechanism for use in a sliding type circular-arc shaped door including door body means having a circular-arc horizontal sectional shape and a transverse door frame having a circular-arc horizontal sectional shape which is mounted on the door body means, the arrangement being made such that the door can be opened and closed by slidably moving said door body means under the transverse frame in such a way as to generate a circular-arc shaped moving locus, said mechanism comprising: a toothed drive pulley and a toothed driven pulley mounted at the one circumferential side end of said transverse door frame and at the other side end thereof, respectively; a toothed endless belt wound between and around said toothed drive pulley and said toothed driven pulley, said toothed endless belt is twisted by an angle of 180 degrees in the vicinity of turning end portions from which, during the movement of said belt, one of inner circular-arc shaped portions of said belt on one side thereof is turned into the outer circular-arc shaped portion, while one of outer circular-arc shaped portions thereof on the other side is turned into the inner circular-arc portion so that, over the major part of said outer circular-arc shaped portions on both sides, the inner surface of said belt having teeth formed thereon adapted to be originally turned inside may be turned outside, while the smooth outer surface thereof adapted to be originally turned outside may be turned inside; and inner and outer guide means arranged so as to kept in contact with the outer surface of the inner circular-arc shaped portions of said toothed endless belt and the inner surface of the outer circular-arc shaped portions thereof, respectively, wherein said door body means is connected to said toothed endless belt.

According to the eighth aspect of the present invention, there is provided an opening/closing mechanism for use in a sliding type circular-arc shaped door as set forth in the seventh aspect, characterized in that said door body means comprises a pair of left and right door bodies each having a circular-arc horizontal sectional shape, said door bodies being allowed to slidably move, in opposite directions with each other along a pair of left and right guide rails, respectively, which are bent in a circular-arc shape concentric with the center of the circular-arc of said transverse door frame, and in that respective circular-arc shapes of said pair of left and right guide rails are concentric with each other, but different from each other in their respective radii.

The above-mentioned and other objects, aspects and advantages of the present invention will become apparent to those skilled in the art by making reference to the following description and the accompanying drawings in which preferred embodiments incorporating the principles of the present invention are shown by way of example only.

BRIEF DESCRIPTION OF THE DRAWINGS

FIG. 3A showing the same when the door is opened, whilst FIG. 3B showing the same when the door is closed;

DETAILED DESCRIPTION OF PREFERRED EMBODIMENTS

The present invention will now be described below by way of several preferred embodiments thereof with reference to the accompanying drawings.

Figure 1:
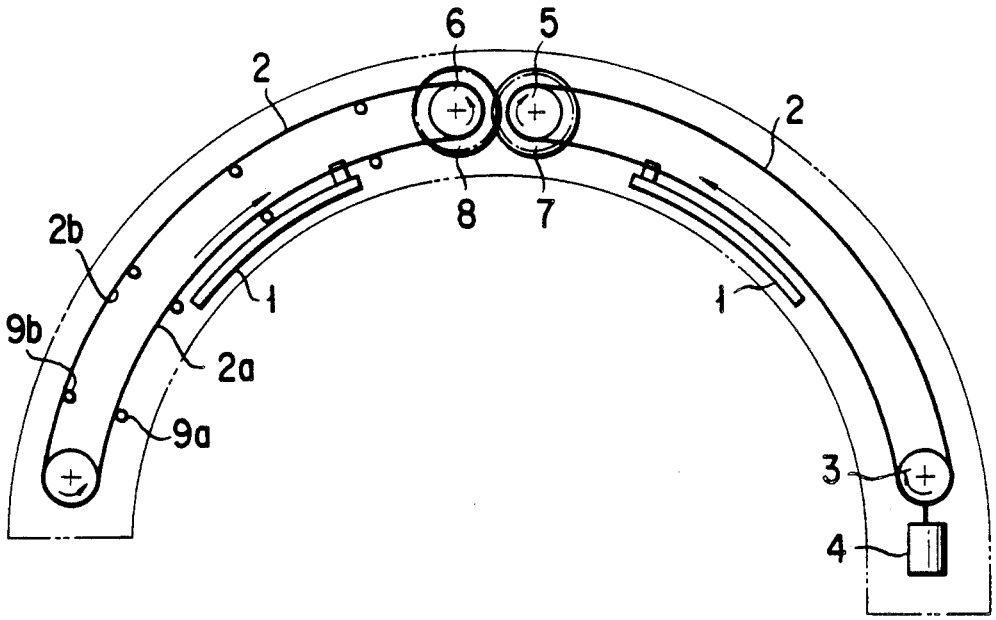
FIG. 1 PRIOR ART
FIG. 1 is a schematic top plan view showing a prior art embodiment.
Figure 2:
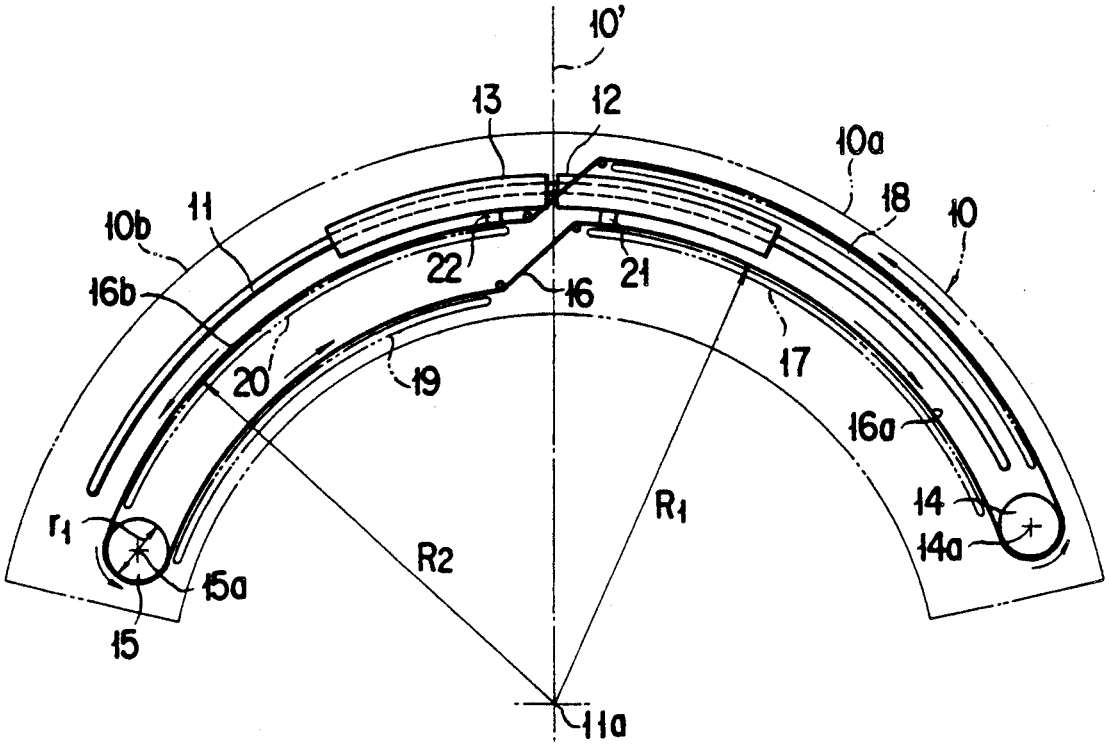
FIG. 2 is a schematic top plan view showing a first embodiment of the present invention.

According to an opening/closing mechanism for use in a circular-arc shaped sliding door of the present invention which is shown, for example, in FIG. 2, a transverse door frame 10 having a circular-arc horizontal sectional shape has mounted thereon a pair of guide rails 11 having a circular-arc horizontal sectional shape concentric with the center of the circular-arc of the transverse door 10. Further, a pair of left and right door bodies 12 and 13 having a circular-arc horizontal sectional shape concentric with the center of the circular-arc of the guide rails 11 are mounted under the transverse door frame 10 in such a manner that they may be moved in opposite directions with each other relative to a door's abutment line 10', which passes through the circumferentially central part of the guide rails 11 and the center **11*a*** of the circular-arc thereof.

A drive pulley 14 is mounted on the one circumferential side end of the above-mentioned transverse door frame 10, and a driven pulley 15 is mounted on the other side end thereof. The drive pulley 14 has a diameter equal to that of the driven pulley 15. The center **15*a* of the driven pulley 15 is located closer to the center 11*a* of the circular-arc of the guide rails than the center 14*a* of the drive pulley 14 relative to that of the guide rails by a distance corresponding to the diameter $r_1$ of the pulleys 14, 15**.

An endless belt 16 is continuously wound between and around the drive pulley 14 and the driven pulley 15.

The above-mentioned endless belt 16 shall be defined as follows. Namely, in the following description, either one of the left and right side relative to the door's abutment line 10', which is the boundary line thereof, is referred to hereinbelow as "one side", and the remaining side as "the other side". Further, the inner peripheral surface of the endless belt 16, which is wound between and around the pulleys 14 and 15, is referred to hereinbelow as "the inner surface", and the outer peripheral surface thereof as "the outer surface". Furthermore, with regard to the positional relationship of the endless belt 16 on both sides with the pulleys 14, 15, respectively, the outer circular-arc shaped portions on both sides of the endless belt 16, which are located within areas where are longer distances from the center **11*a* than those of lines (or radiuses of circular-arcs), respectively, connecting respective circular-arcs passing through the center of the pulleys 14, 15 with the center 11*a* of the circular-arc of the guide rails (or the radius of the circular-arc) are referred to hereinbelow as "the outer circular-arc", and the circular-arc shaped portions of the endless belt 16** which are located inside the above-mentioned areas as "the inner circular-arc".

Further, to guide the movement of the endless belt 16, an inner circular-arc shaped guide 17 and an outer circular-arc shaped guide 18, each of which consists of a circular-arc shaped strip concentric with the center of the circular-arc of the guide rails 11, or a plurality of rollers arranged along an imaginary circular-arc shaped locus concentric with the center of the circular-arc of the guide rails 11 are mounted on one side **10*a* (the right side in the drawing) of the transverse door frame 10 relative to the door's abutment line 10' forming the boundary line, whilst the inner circular-arc shaped guide 19 and an outer circular-arc shaped guide 20 both having the same construction are mounted on the other side 10*b* (the left side in the drawing) of the transverse door frame 10 relative to the door's abutment line 10'. The inner circular-arc shaped guide 17 and the outer circular-arc shaped guide 18 which are located on one side are mounted inside and outside of the guide rails 11. The circular-arc shaped guide 17 located on one side serves to guide the inner circular-arc shaped portion 16*a* of the endless belt 16 so as to move in such a way as to generate a circular-arc shaped locus concentric with the center 11*a* of the circular-arc of the guide rails 11. Whilst, the above-mentioned outer circular-arc shaped guide 20 located on the other side is mounted inside the guide rails 11 and serves to guide the outer circular-arc shaped portion 16*b* of the endless belt 16 on the other side so as to move in such a way as to generate a circular-arc shaped locus concentric with the center of the circular-arc of the above-mentioned inner circular-arc shaped portion 17 located on one side of the transverse door frame 10**.

Stating in brief, the radius $R_1$ of the circular-arc shaped moving locus defined by the inner circular-arc shaped portion **16*a* located on one side of the belt 16 is substantially equal to the radius $R_2$ of the circular-arc shaped moving locus defined by the outer circular-arc shaped portion 16*b*** thereof on the other side.

Further, the inner circular-arc shaped portion **16*a* of the endless belt 16 on one side is connected to the door body 12 by means of a connector 21, whilst the outer circular-arc shaped portion 16*b* thereof on the other side is connected to the another door body 13 by means of a connector 22**.

Such being the arrangement, when the endless belt 16 is turned either in one direction or in the reverse direction, the inner circular-arc shaped portion **16*a* of the belt on one side and the outer circular-arc shaped portion 16*b* thereof on the other side are moved in opposite directions relative to each other in such a way as to generate a circular-arc shaped locus concentric with the center 11*a* of the circular-arc of the guide rails 11 so that the pair of door bodies 12, 13 may be moved smoothly along the guide rails 11** either in the opening direction or in the closing direction in such a way as to generate a circular-arc shaped moving locus in a horizontal plane to thereby enable the circular-arc shaped door to be opened or closed.

When the drive pulley 14 is turned, for example, in a direction shown by an arrow from the condition that the door is closed as shown in FIG. 2 so as to turn the endless belt 16, the inner circular-arc shaped portion 16a on one side is moved towards one side as shown by an arrow, and the outer circular-arc shaped portion 16b on the other side is moved towards the other side as shown by an arrow so that the pair of door members 12, 13 may be moved in opposite direction to thereby open the circular-arc shaped double-sliding type door.

A second embodiment of the present invention will now be described below with reference to FIGS. 3A to 4D.

Stating in brief, in this embodiment, a plurality of rollers are used to form each of the guides, since if each of the above-mentioned guides is formed in a configuration having a circular-arc shaped continuous guide surface, the resistance to sliding of the endless belt 16 will increase.

As shown in FIGS. 4A to 4D, the transverse door frame 10 is of a box-like sectional shape having a slit-shaped opening 30 formed in the lower part thereof. The transverse door frame 10 has a circumferentially extending longitudinal plate 31 fixedly secured therein. Each of the above-mentioned guide rails 11 is fixedly secured to the lower part of the longitudinal plate 31. Although only one of the door bodies is shown in the drawing, an L-shaped hanger 32 is fixedly secured to the upper part of each of the pair of door bodies 12 and 13. The hanger 32 has upper roller 33 and lower roller 34 mounted rotatably thereon. The upper and lower rollers 33 and 34 mounted on each of the hangers 32 are adapted to move on and along the guide rails 11. Further, the longitudinal plate 31 has an L-shaped guide bracket 35 fixedly secured thereto.

Figure 4A:
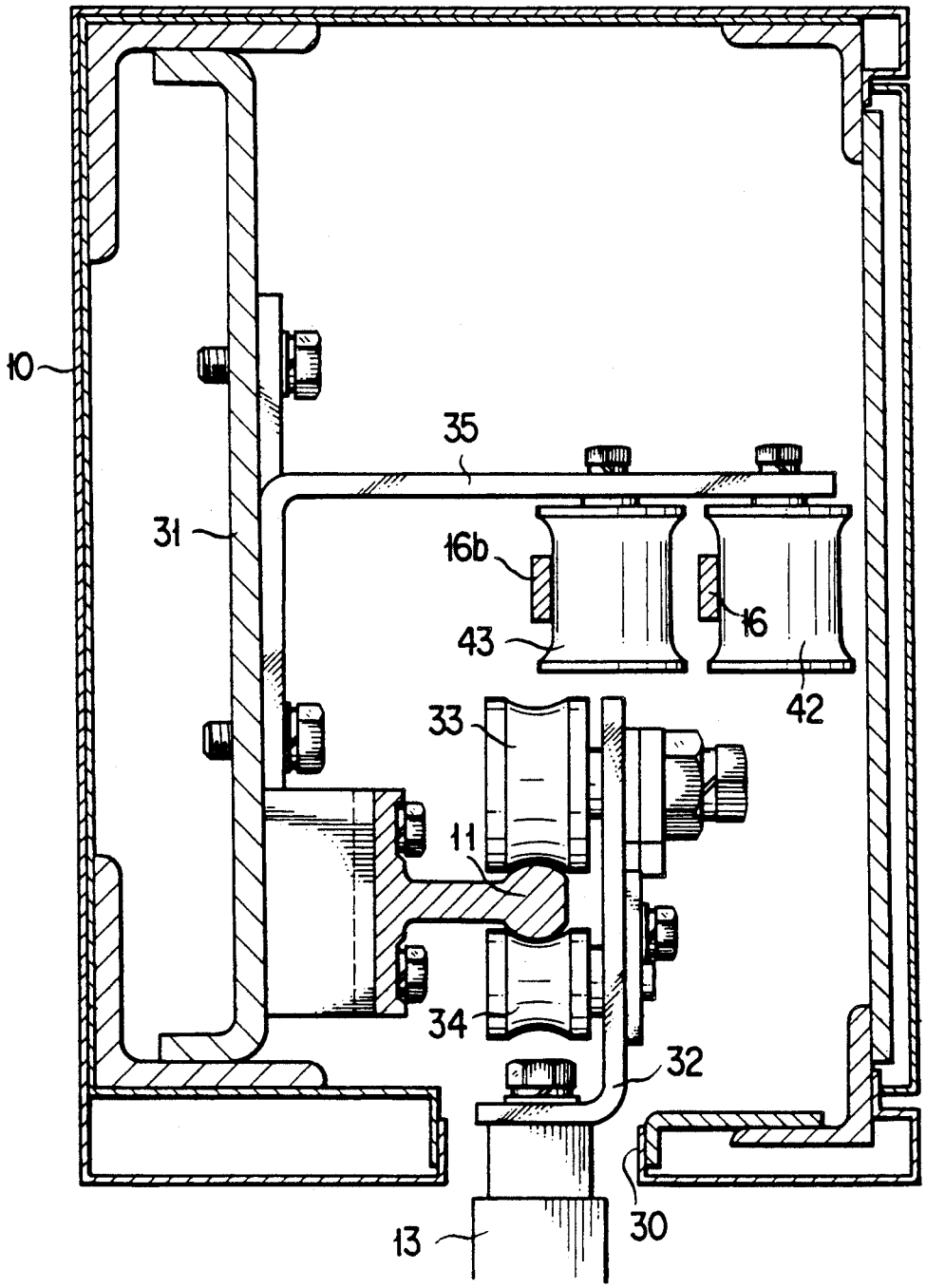
FIGS. 4A, 4B, 4C and 4D are sectional views of the principal parts of the embodiment shown in FIG. 3B taken along lines IVA—IVA, IVB—IVB, IVC—IVC, and IVD—IVD, respectively.
Figure 4B:
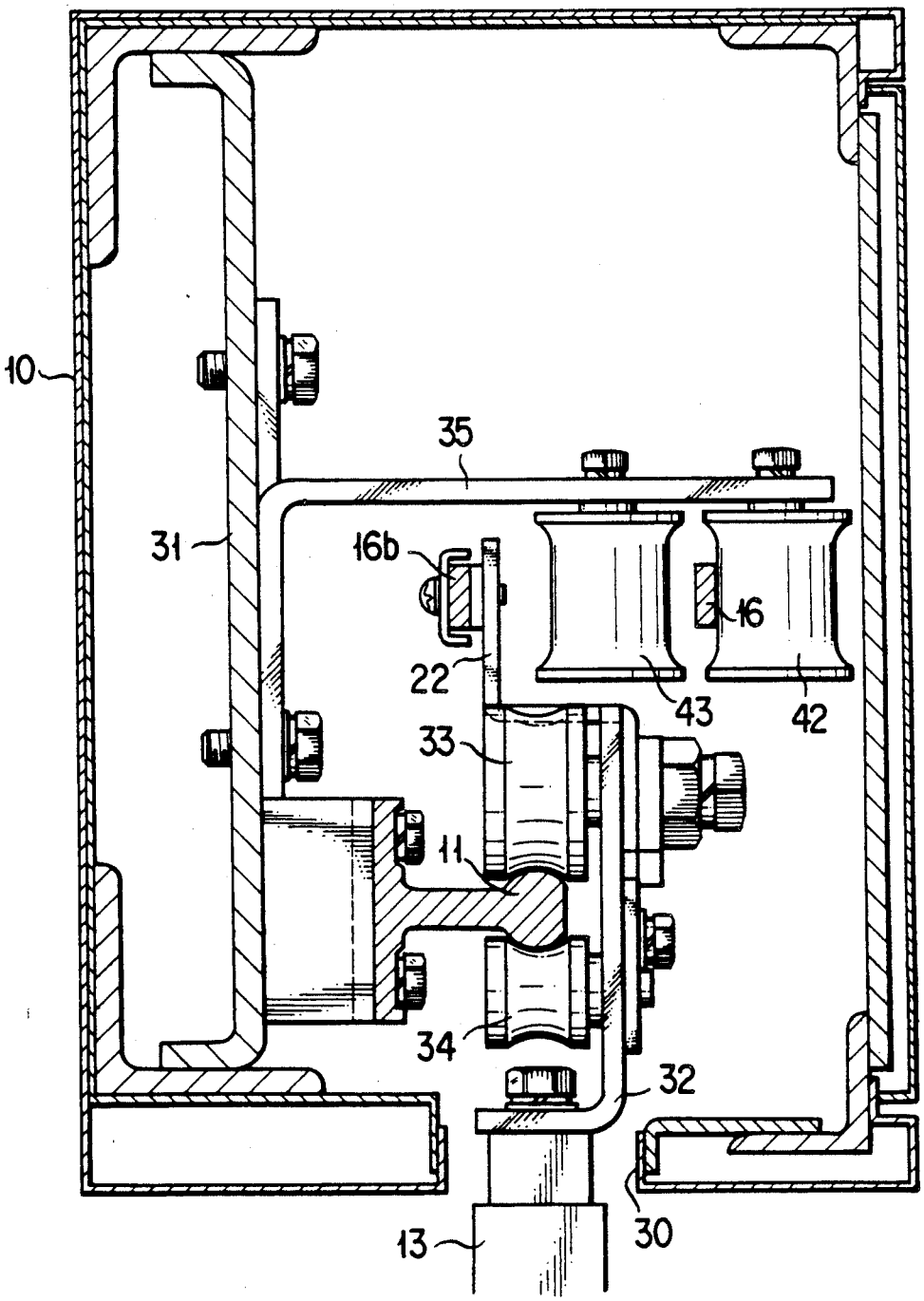
Figure 4C:
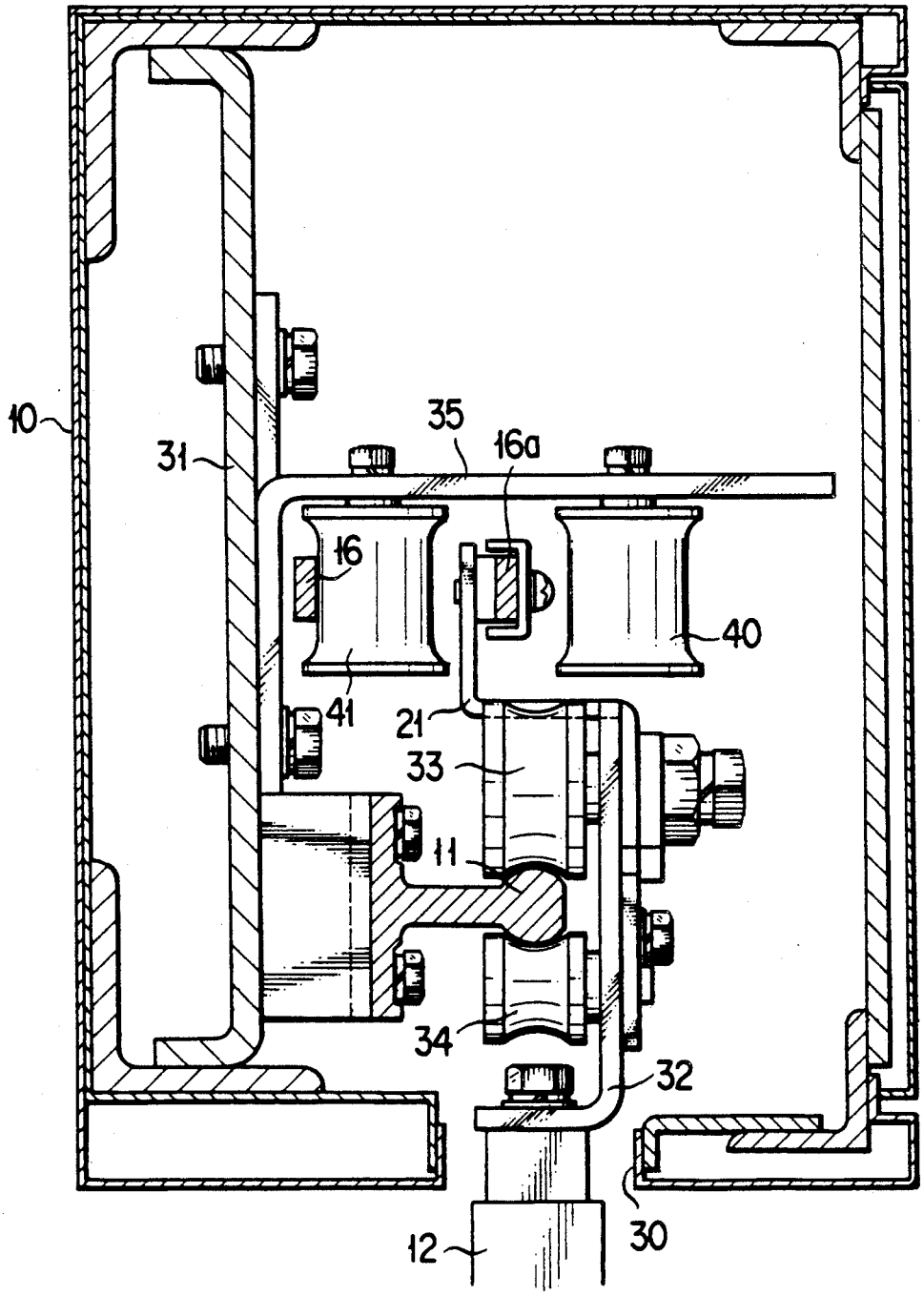
Figure 4D:
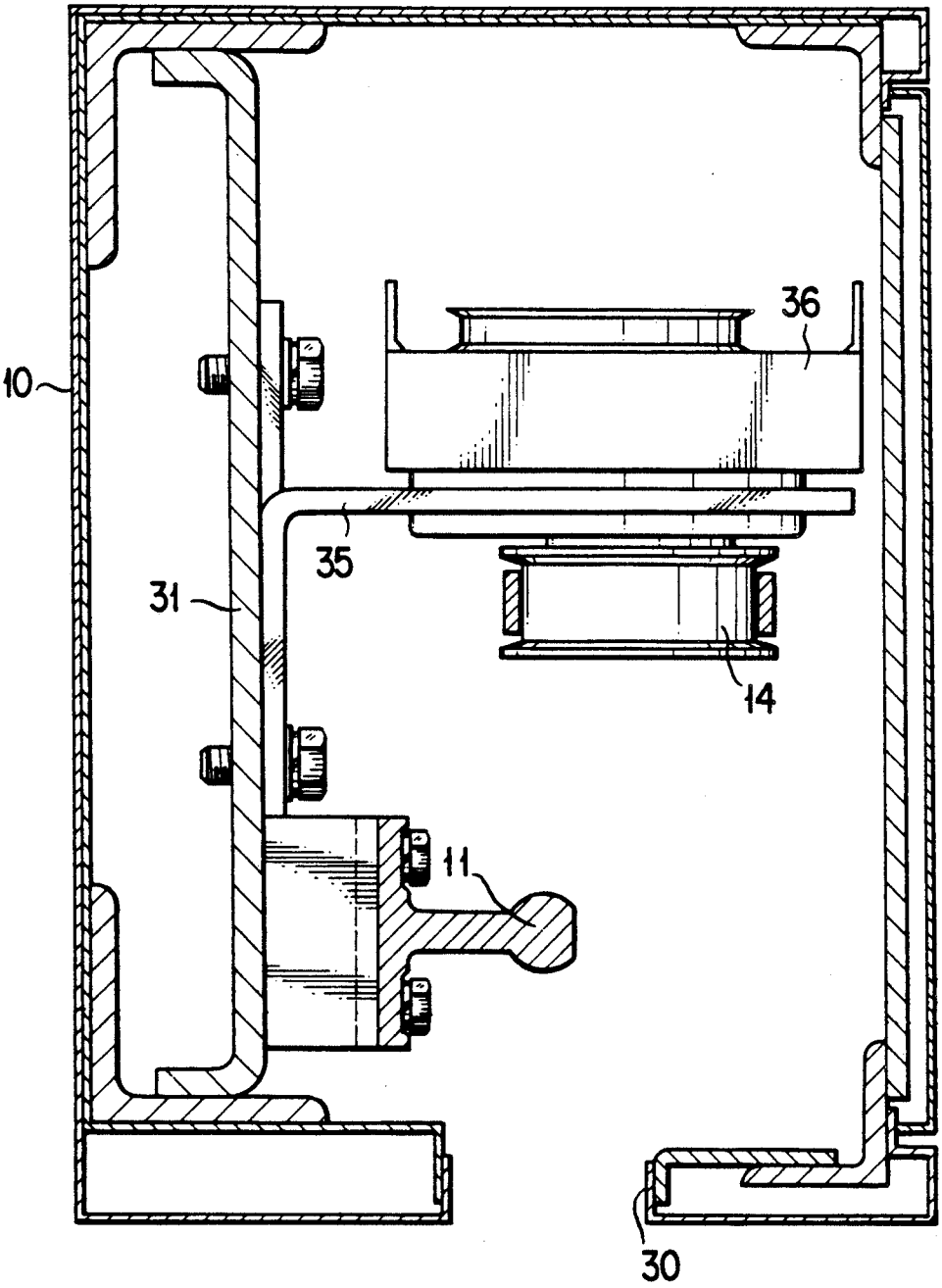

As shown in FIG. 4D, a drive pulley 14 is journalled on the one longitudinal end of the above-mentioned guide bracket 35 in such a manner that it may be rotated freely in a horizontal plane. Further, a drive motor 36 is mounted on one end of the guide bracket 35 and is coupled to the drive pulley 14. The hanger 32, to which the door body 12 is connected, has a connector 21 mounted on the longitudinally intermediate part thereof as shown in FIG. 4C. The connector 21 is connected to the inner circular-arc shaped portion 16a of the endless belt 16 located on one side. Further, as shown in FIG. 4B, the hanger 32 of the another door 13 has a connector 22 mounted on the longitudinally intermediate part thereof. The connector 22 is connected to the outer circular-arc shaped portion 16b of the endless belt 16 located on the other side. As shown in FIG. 4C, the above-mentioned guide bracket 35 has a plurality of inner guide rollers 40 and a plurality of outer guide rollers 41, which form the inner and outer circular-arc shaped guides, respectively, mounted on one side. The inner guide rollers 40 are circumferentially spaced apart with one another, and also the outer guide rollers 41 are spaced apart with one another in the same manner. As shown in FIGS. 4A and 4B, the guide bracket 35 has a plurality of inner guide rollers 42 and a plurality of outer guide rollers 43, which form the inner and outer circular-arc shaped guides, respectively, mounted on the other side. The inner guide rollers 42 are circumferentially spaced apart with one another, and the outer guide rollers 43 are also spaced apart with one another.

Figure 3A:
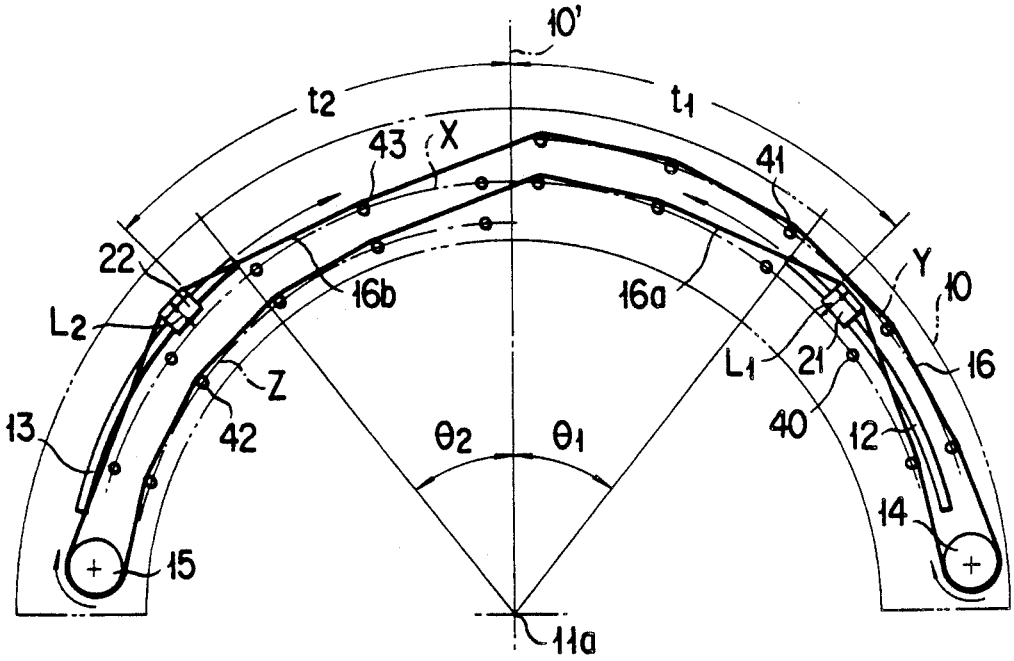
FIGS. 3A and 3B are schematic top plan views showing a second embodiment of the present invention, respectively.
Figure 3B:
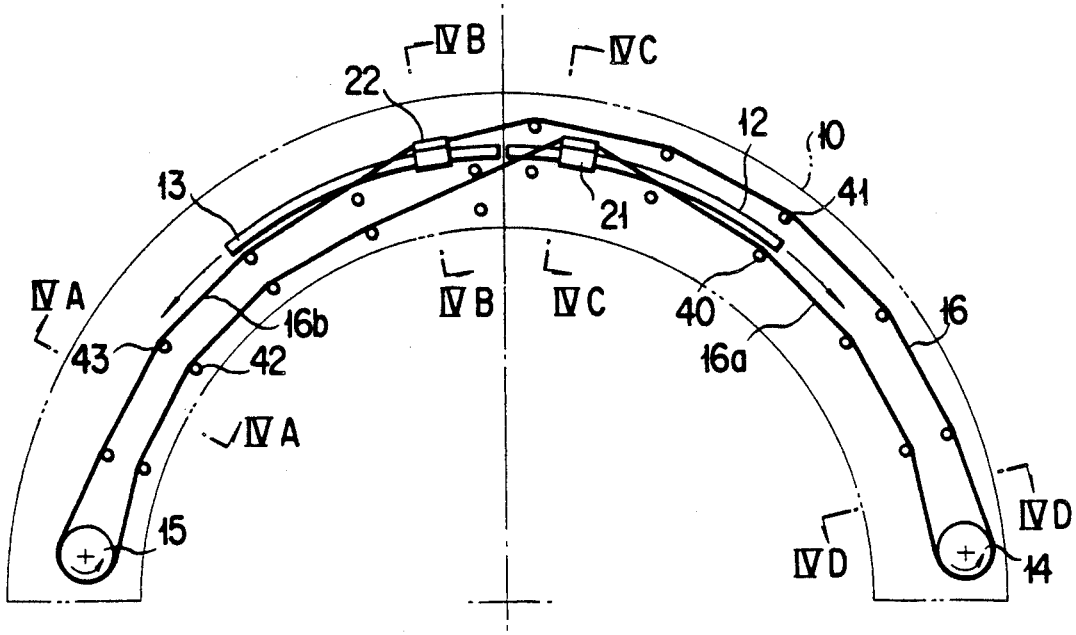

The above-mentioned guide rollers 40, 41, 42 and 43 are arranged as shown in FIGS. 3A and 3B.

Stating in brief, a plurality of inner guide rollers 40 located on one side of the transverse door frame 10 and a plurality of outer guide rollers 43 located on the other side thereof are arranged at regular intervals relative to one another along an imaginary circular-arc shaped locus x concentric with the center 11a of the circular-arc of the guide rails 11. The plurality of outer guide rollers 41 located on one side of the transverse door frame 10 are arranged at regular intervals to one another along an imaginary circular-arc shaped locus Y whose radius is larger than that of the above-mentioned imaginary circular-arc shaped locus X. Further, the plurality of inner guide rollers 42 located on the other side of the transverse door frame 10 are arranged at regular intervals to one another along an imaginary circular-arc shaped locus Z whose radius is smaller than that of the aforementioned imaginary circular-arc shaped locus X.

The above-mentioned pair of door bodies 12 and 13 are adapted to be moved in opposite directions to each other relative to the door's abutment line 10', which passes through the circumferentially central part of the transverse door frame 10 and the center of the circular-arc of the guide rails, by angles $\theta_1$ and $\theta_2$ so that they may be opened and closed. The angle $\theta_1$ is equal to the angle $\theta_2$. Further, the distance $L_1$ between the connecting portion of the door body 12 with the inner circular-arc shaped portion 16a of the endless belt 16 on one side of the transverse door frame 10 and the imaginary circular-arc shaped locus X is equal to the distance $L_2$ between the connecting portion of the another door body 13 with the outer circular-arc shaped portion 16b on the other side of the transverse door frame 10 and the imaginary circular-arc shaped locus X. Further, the distance $t_1$ between the connecting portion 21 of the door body 12 and the door's abutment line 10', which passes through the circumferentially central part of the transverse door frame 10, is equal to the distance $t_2$ between the connecting portion 22 of the door body 13 and the door's abutment line 10'. Thus, the arrangement is made such that when the drive motor 36 (see FIG. 4D) is rotated forwardly or reversely to rotate the drive pulley 14 forwardly or reversely so as to turn the endless belt 16 forwardly or reversely, the connecting portion 21 of the door body 12 with the inner circular-arc shaped portion 16a of the endless belt 16 on one side of the transverse door frame 10, and the connecting portion 22 of the door body 13 with the outer circular-arc shaped portion 16b of the belt on the other side of the transverse door frame 10 are moved, respectively, in opposite directions to each other in such a way as to generate a circular-arc shaped locus concentric with the center 11a of the circular-arc of the guide rails 11.

A third embodiment of the present invention will now be described with reference to FIGS. 5 to 7C.

The component parts of this embodiment, which are the same as those used in the foregoing description of the first and second embodiments, are denoted with the same reference numerals, and therefore the description of them is omitted. Further, the definitions of them are identical to those of the aforementioned component parts.

The above-mentioned transverse door frame 10 has a toothed drive pulley 14 mounted on the one circumferential side end thereof, and a toothed driven pulley 15 mounted on the other side end thereof. The diameter of the toothed drive pulley 14 is equal to that of the toothed pulley 15.

An endless belt 16, which is comprised of a toothed belt, is wound around the above mentioned toothed drive pulley 14 and toothed drive pulley 15. On one side of the transverse frame close to the toothed drive pulley 14 and on the other side thereof close to the toothed drive pulley 15, there are provided a toothed guide roller 18*b* and a toothed guide roller 20*b*, respectively, which mesh with the teeth 16*t* formed partially on the inner surfaces of the outer circular-arc shaped portions 16*a*$_2$ and 16*b*$_2$, respectively, of the endless belt 16. The arrangement is made such that the outer circular-arc shaped portions 16*a*$_2$ and 16*b*$_2$ each twisted by an angle of 180 degrees at positions spaced somewhat apart from the toothed guide rollers 18*b* and 20*b*, respectively, toward the door body's abutting point to allow the inner surface having teeth 16*t* formed thereon to be turned outside and the smooth outer surface to be turned inside.

Such being the arrangement, the endless belt 16 can be guided smoothly without the need for forming teeth on the inner guide rollers 17*a* and 19*b* serving to guide the smooth outer surface (without teeth) of the inner circular-arc shaped portion 16*b* of the endless belt 16, and also on the outer guide rollers 18*a* and 20*a* serving to guide the smooth outer surface (having no teeth) of the outer circular-arc shaped portion 16*a*. Therefore, the level of the noise which occurs, in the arrangement of the prior art example, when a plurality of toothed guide rollers are engaged with and disengaged from the teeth 16*t* on the endless belt 16 can be reduced considerably.

Further, since the above-mentioned third embodiment uses the double-sliding type circular-arc shaped door having a pair of door bodies 12 and 13, the center 15*a* of the toothed driven pulley 15 is located closer to the center 11*a* of the circular-arc of the guide rails 11 than the center 14*a* of the toothed drive pulley 14 by a distance corresponding to the diameter of the pulleys 14 and 15. Further, the inner guide rollers 17*a*, 19*a* and the outer guide rollers 18*a*, 20*a* are located on one side A and on the other side B, respectively, which are divided by the door's abutment line 10' which passes the circumferentially central part of the transverse door frame 10 and the center of the circular-arc of the guide rails 11. Still further, the inner guide roller 17*a* on one side A and the outer guide roller 20*a* on the other side B are located, respectively, along an imaginary circular-arc shaped locus X concentric with the center 11*a* of the circular-arc of the guide rails 11, whilst the other guide roller 18*a* on one side A is located along an imaginary circular-arc shaped locus Y whose radius is larger than that of the imaginary circular-arc shaped locus X, and the inner guide roller 19*a* on the other side B is located along an imaginary circular-arc shaped locus Z whose radius is smaller than that of the locus X. Furthermore, the inner circular-arc shaped portion 16*a*, of the endless belt on one side A is connected to the door body 12 by means of the connector 21, and the outer circular-arc shaped portion 16*b*$_2$ of the endless belt 16 on the other side B is connected to the another door body 13 by means of the connector 22.

Figure 7A:
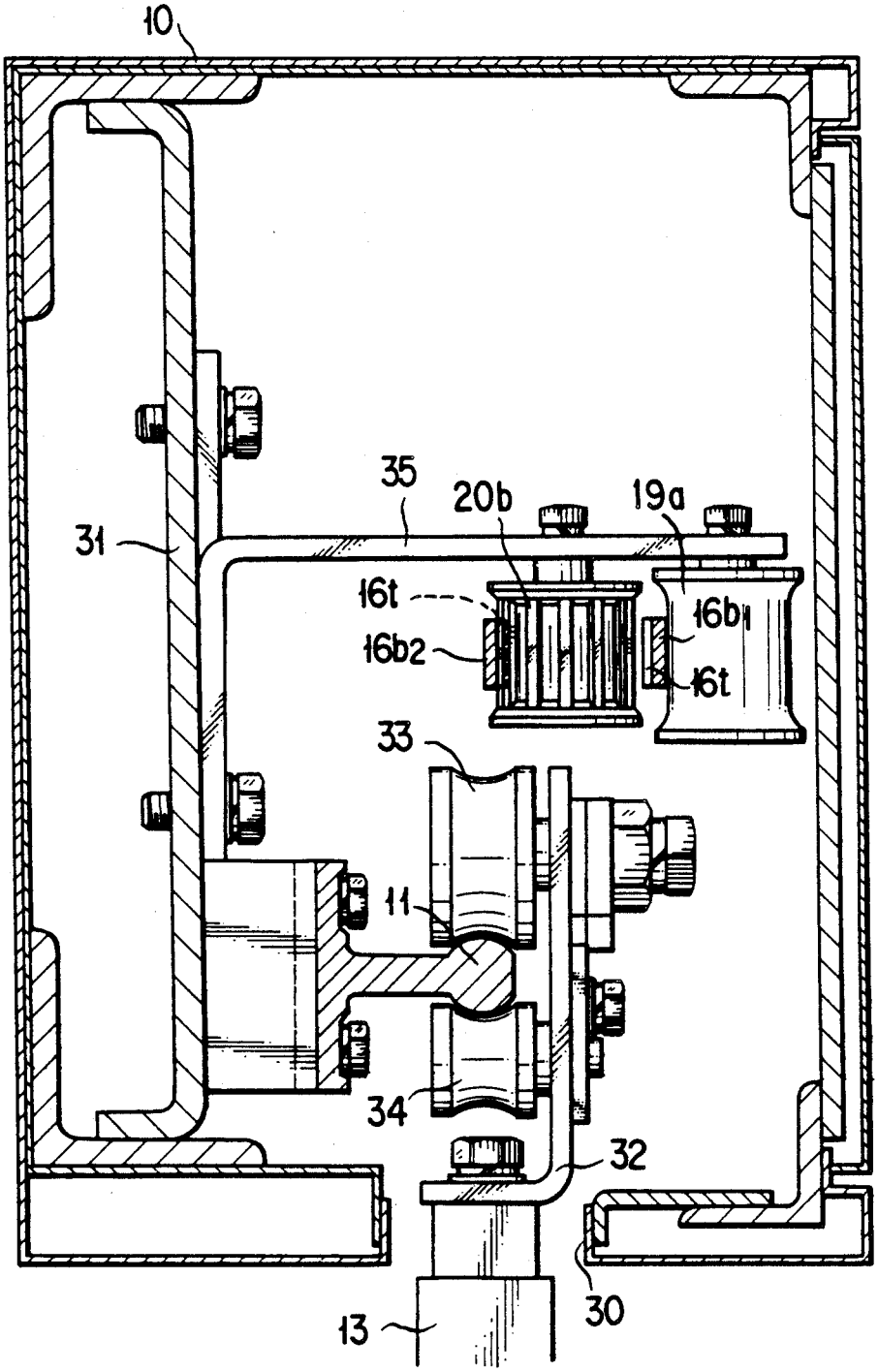
FIGS. 7A, 7B and 7C are sectional views of the principal parts of the embodiment shown in FIG. 5 taken along lines VIIA—VIIA, VIIB—VIIB, and VIIC—VIIC, respectively.
Figure 7B:
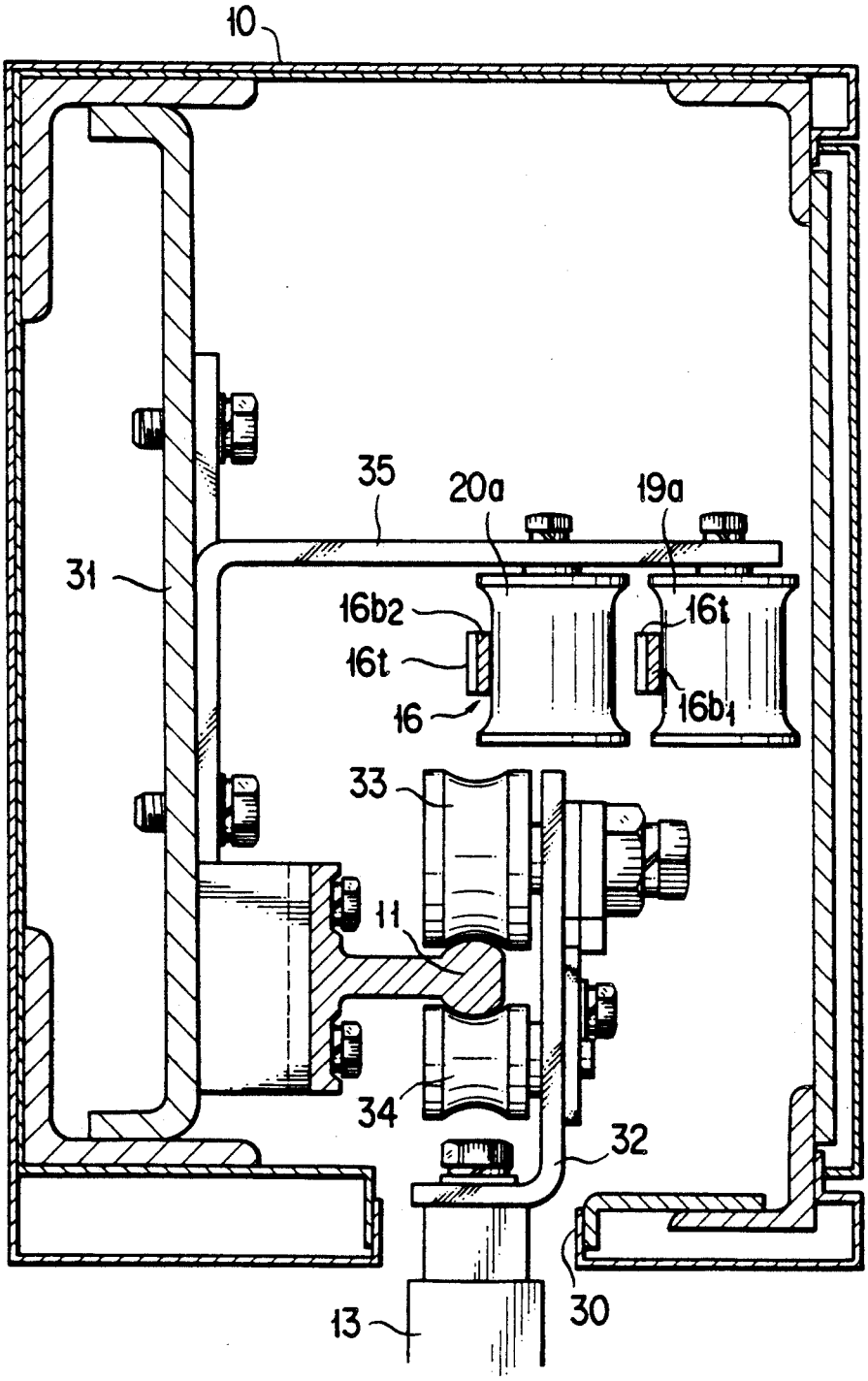
Figure 7C:
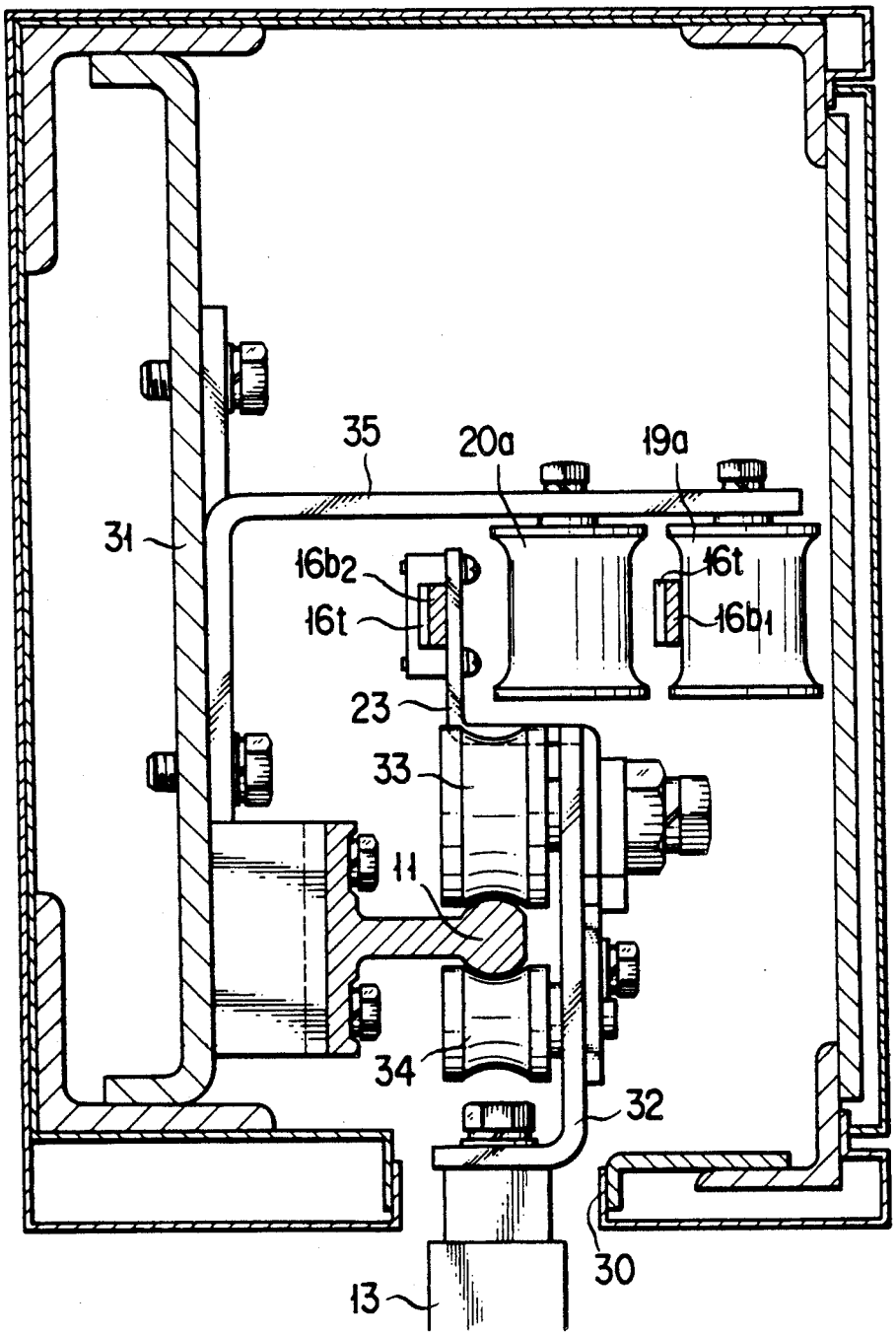

Further, the details of the configuration of each of the component parts are shown in FIGS. 7A, 7B and 7C.

Stating in brief, as shown in FIGS. 7A to 7C, the transverse door frame 10 is of a box-like sectional shape having a slit-shaped opening 30 formed in the lower part thereof. The transverse door frame 10 has a circumferentially extending longitudinal plate 31 fixedly secured therein. Each of the above-mentioned guide rails 11 is fixedly secured to the lower part of the longitudinal plate 31. An L-shaped hanger 32 is fixedly secured to the upper part of each of the door bodies 12 and 13. The hanger 32 has upper roller 33 and lower roller 34 mounted rotatably thereon. The upper and lower rollers 33 and 34 mounted on the hanger 32 are adapted to run on and along the guide rails 11. Further, the longitudinal plate 31 has an L-shaped guide bracket 35 fixedly secured thereto.

As shown in FIG. 7A, a toothed guide roller 20*b* and an inner guide roller 19*a* are mounted on the above-mentioned guide bracket 35 at positions near the longitudinal end thereof on the other side. Further, as shown in FIG. 7B, an inner guide roller 19*a* and an outer guide roller 20*a* are mounted on the longitudinally intermediate portion of the guide bracket 35. Furthermore, as shown in FIG. 7C, the outer circular-arc shaped portion 16*b*$_2$ of the endless belt 16 on the other side B is connected to the connector 22 on the other side B.

Further, the same arrangement as the aforementioned is made on one side A relative to the door's abutment line 10' which passes through the circumferentially center part of the transverse door frame 10 and the center 11*a* of the circular-arc of the guide rails 11.

Such being the arrangement, when the endless belt 16 is turned either in one direction or in the reverse direction, the inner circular-arc shaped portion 16*a*$_1$ of the belt 16 on one side A and the outer circular-arc shaped portion 16*b*$_2$ thereof on the other side B are moved in opposite directions with each other in such a way as to generate a circular-arc shaped locus concentric with the center 11*a* of the circular-arc of the guide rails 11 so that the pair of door bodies 12 and 13 may be moved smoothly along the guide rails 11 either in the opening direction or in the closing direction in such a way as to generate a circular-arc shaped moving locus in a horizontal plane to thereby enable the circular-arc shaped door to be opened or closed.

Figure 5:
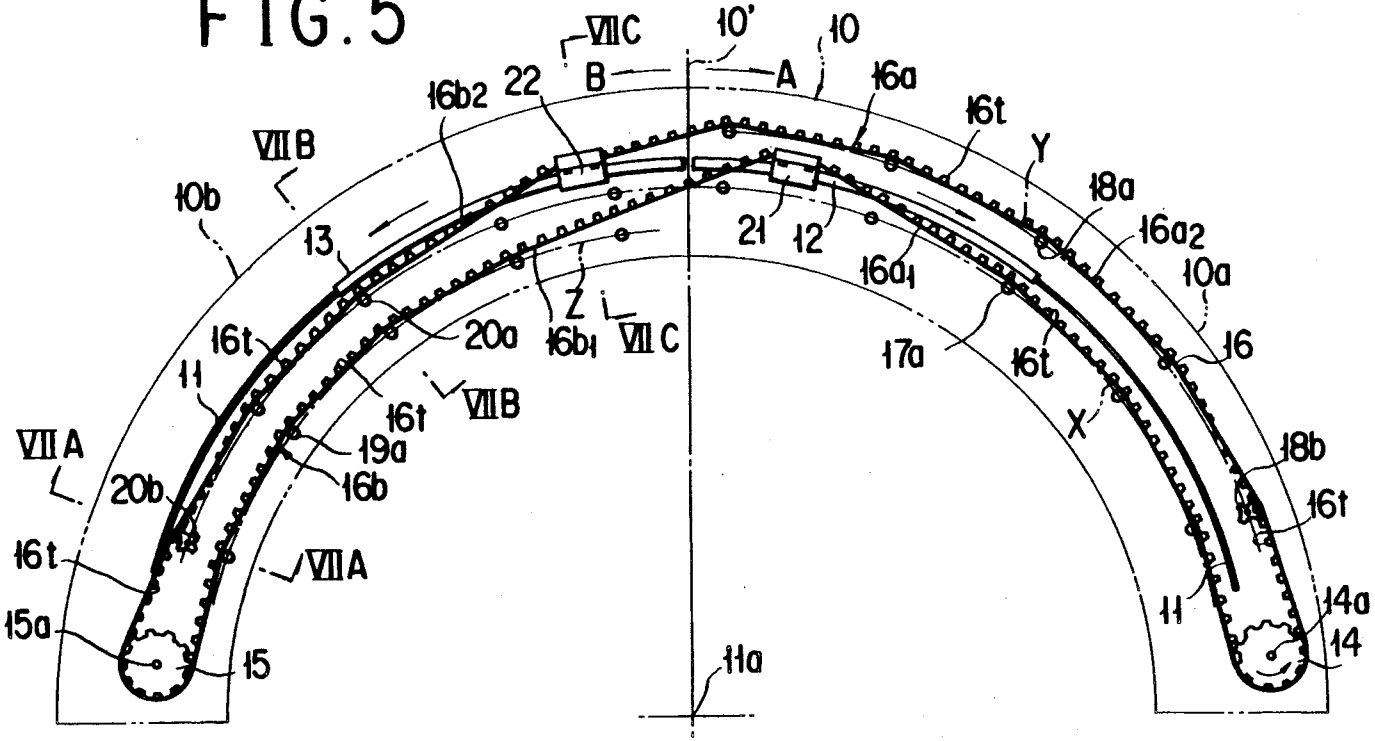
FIG. 5 is a schematic top plan view showing a third embodiment of the present invention.
Figure 6:
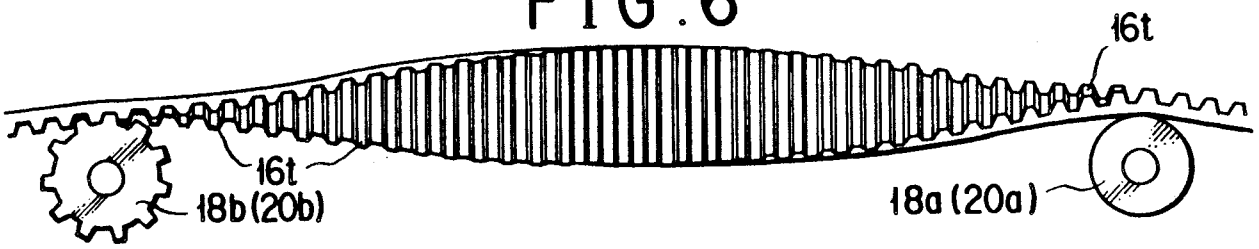
FIG. 6 is a plan view showing a twisted condition of a toothed endless belt for use in the embodiment shown in FIG. 5.

If, for example, the toothed drive pulley 14 is rotated from its closed condition as shown in FIG. 5 in the direction shown by an arrow to turn the endless belt 16, then the inner circular-arc shaped portion 16*a*$_1$ of the belt 16 on one side A is moved towards one side as shown by an arrow, whilst the outer circular-arc shaped portion 16*b*$_2$ on the other side B is moved towards the other side as shown by an arrow, so that the pair of door bodies 12 and 13 may be moved in opposite directions to each other and away from the door body's abutting point thereby enable the circular-arc shaped double-sliding door to be opened.

Figure 8:
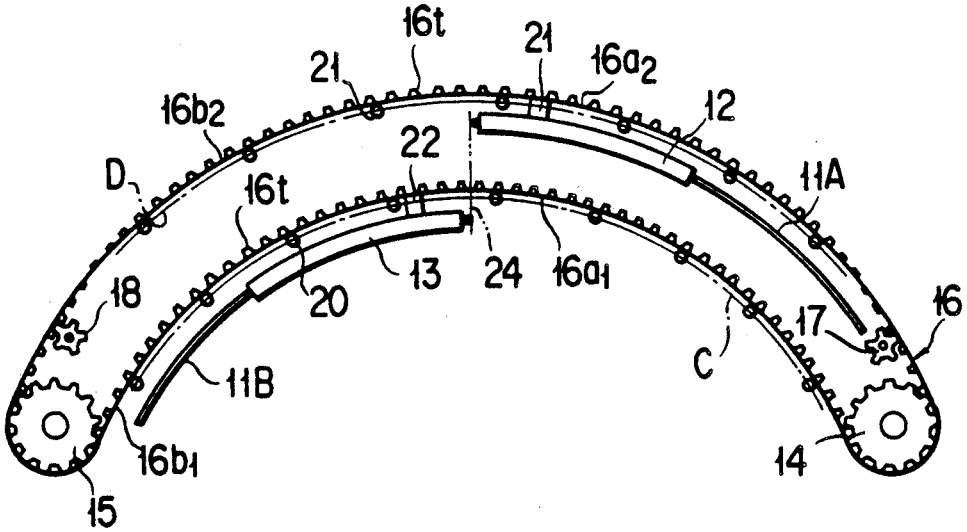
FIG. 8 is a schematic top plan view showing a fourth embodiment of the present invention.

Further, the arrangement may be made such that, as shown in FIG. 8, the inner guide roller 19*a* and the outer guide roller 20*a* are located along concentric imaginary inner and outer circular-arcs C and D, respectively; the door body 12 is connected to the outer circular-arc shaped portion 16*a*$_2$ of the endless belt 16 on one side by means of the connector 21 located on one side and the another door body 13 is connected to the inner circular-arc shaped portion 16*b*$_1$ of the endless belt 16 on the other side by means of the connector 22 located on the other side; and further the guide rail is divided into a guide rail 11A located on one side and another guide rail 11B located on the other side. In this case, it is possible to make the diameter of the former guide rail different from that of the latter guide rail.

In this case, however, since when the pair of door bodies 12 and 13 assume their closed positions they cannot be abutted against each other, provision of an abutting member 24 or the like is required so as not to create any clearance between the pair of door bodies 12 and 13.

Although the foregoing embodiments relate to double-sliding type circular-arc shaped doors, it is needless to say that the present invention can be applied to single-sliding type circular-arc shaped doors as well.

It is to be understood that the foregoing description is merely illustrative of preferred embodiments of the present invention, and that the scope of the invention is not to be limited thereto, but is to be determined by the scope of the appended claims.

What is claimed is:

1. An opening/closing mechanism for use in a double-sliding type circular-arc shaped door including a pair of left and right door bodies each having a circular-arc horizontal sectional shape, and a transverse door frame having a circular-arc horizontal sectional shape and including circular-arc guide rails on which the door bodies are mounted for guiding the door bodies, respectively, in such a way as to generate circular-arc shaped moving loci, respectively, said door bodies being slidably movable under the transverse frame, in opposite directions relative to each other relative to a door abutment line, which passes through a circumferentially central part of the transverse frame and a the center of the circular-arc of guide rails such that the door can be opened and closed, said mechanism comprising:

a drive pulley mounted on one circumferential side end of said transverse door frame and a single pulley mounted on another side end of said transverse door frame and connected to a means for driving said driven pulley;

a single endless belt being twisted by an angle of 180 degrees in a vicinity of turning end portions and wound between and around the drive pulley and the driven pulley so that one of inner circular-arc shaped portions of the belt on one side and one of outer circular-arc shaped portions thereof on the other side, which are defined, respectively, relative to the door abutment line, is movable in such a way as to generate circular-arc shaped loci having equal radius to each other and each of the loci being concentric with the center of the moving locus defined by each of said door bodies; and inner and outer guide means arranged whereby contact with the outer surfaces of the inner circular-arc shaped portions of the endless belt and the inner surfaces of the outer circular-arc shaped portions thereof, respectively, wherein one of said pair of door bodies is connected to one of the inner circular-arc shaped portions of said endless belt on one side another of said door bodies being connected to one of the outer circular-arc shaped portions of said endless belt on the other side.

2. An opening/closing mechanism for use in a circular-arc shaped sliding door as claimed in claim 1, wherein said inner and outer guide means are strips each having a circular-arc shape concentric with the center of the circular-arc of said transverse door frame.

3. An opening/closing mechanism for use in a circular-arc shaped sliding door as claimed in claim 1, wherein each of said inner and outer guide means is a plurality of rollers arranged at regular intervals from one another along a circular-arc with a center of the circular-arc being at a center of the circular-arc of said transverse door frame.

4. An opening/closing mechanism for use in a circular-arc shaped sliding door as claimed in claim 1, wherein said circular-arc guide rails are a pair of left and right guide rails each bent in a circular-arc shape concentric with the center of the circular-arc of said transverse door frame, said pair of door bodies being mounted on respective ones of said left and right guide rails for movement in opposite directions relative to one another.

5. An opening/closing mechanism for use in a double-sliding type circular-arc shaped sliding door including a pair of left and right door bodies each having a circular-arc horizontal sectional shape, and a transverse door frame having a circular-arc horizontal sectional shape including circular-arc guide rails on which the door bodies are mounted for guiding the door bodies in such a way as to generate circular-arc shaped moving loci, respectively, said door bodies being slidably movable under the transverse frame, in opposite directions relative to each other relative to a door abutment line, which passes through a circumferentially central part of the transverse frame and a center of circular-arc of guide rails such that the door can be opened and closed, said mechanism comprising:

a drive pulley mounted on one circumferential side end of said transverse door frame and a driven pulley on another side end of said transverse door frame, the driven pulley being connected to a means for driving said driven pulley, both said drive pulley and said driven pulley being toothed pulleys, an endless belt wound between and around the drive pulley and the driven pulley so that one of inner circular-arc shaped portions of the belt on one side and one of outer circular-arc shaped portions thereof on the other side, which are defined, respectively, relative to the door abutment line, is movable in such a way as to generate circular-arc shaped loci having equal radius to each other and each of the loci being concentric with the center of the moving locus defined by each of said door bodies, said endless belt wound between and around said toothed pulleys being a toothed belt, and the toothed endless belt being mounted twisted by an angle of 180 degrees in a vicinity of turning end portions from which, during the movement of said belt, one of the inner circular-arc shaped portions of said belt on one side thereof is turned into an outer circular-arc shaped portion, while one of outer circular-arc shaped portions thereof on the other side is turned into an inner circular-arc portion so that, over a major part of the outer circular-shaped portions on both sides, an inner surface of the belt having teeth formed thereon adapted to be originally turned inside is turned outside, whilst a smooth outer surface of the belt adapted to be originally turned outside is turned inside, and inner and outer guide means arranged in contact with the outer surfaces of the inner circular-arc shaped portions of the endless belt and inner surfaces of the outer circular-arc shaped portions thereof, respectively, said outer guide means being kept in contact with said inwardly turned smooth outer surfaces of the outer circular-arc shaped portions of the belt said inner guide means being kept contact with the inwardly smooth outer surfaces of said inner circular-arc shaped portions of the belt, one of said pair of door bodies being connected to one of the inner circular arc shaped portions of said endless belt on one side, another of said door bodies being connected to one of the outer circular-arc shaped portions of said endless belt on the other side.

6. An opening/closing mechanism for use in a double-sliding type circular-arc shaped sliding door including a pair of left and right door bodies each having a circular-arc horizontal sectional shape, and a transverse door frame having a circular-arc horizontal sectional shape and including a circular-arc guide rails on which the door bodies are mounted for guiding the door bodies in a way to generate circular-arc shaped loci, respectively, the door bodies being slidably movable under the transverse door frame in opposite directions relative to each other relative to a door abutment line, which passes through a circumferentially central part of the transverse door frame and a center of the circular-arc guide rails such that the door can be opened and closed, said mechanism comprising:

a drive pulley mounted on one circumferential side end of said transverse door frame and a driven pulley mounted on another side end of said transverse door frame, said driven pulley having a diameter equal to that of said pulley, and a center of the driven pulley being located closer to a center of the circular-arc of the guide rails than a center of the drive pulley relative to that of the guide rails by a distance corresponding to the diameter of the drive pulley so that a radius of the circular-arc shaped moving locus defined by the inner circular-arc shaped portion of an endless belt on one side is substantially equal to that of the circular-arc shaped moving locus defined by the outer circular-arc shaped portion thereof on the other side;

an endless belt wound between and around the drive pulley and the driven pulley so that one of inner circular-arc shaped portions of the belt on one side and one of outer circular-arc shaped portions thereof on the other side, which are defined, respectively, relative to the door abutment line, is movable in such a way as to generate circular-arc shaped loci having equal radius to each other and each of the loci being concentric with the center of the moving locus defined by each of said door bodies; and inner and outer guide means arranged so as to be kept in contact with the outer surfaces of the inner circular-arc shaped portions of the endless belt and the inner surfaces of the outer circular-arc shaped portions thereof, respectively, wherein one of said pair of door bodies is connected to one of the inner circular-arc shaped portions of said endless belt on one side, whilst another door body is connected to one of the outer circular-arc shaped portions of said endless belt on the other side.

7. An opening/closing mechanism for use in a sliding type circular-arc shaped door including a door body having a circular-arc horizontal sectional shape, and a transverse door frame having a circular-arc horizontal sectional shape which is mounted on the door body, said door body being slidably movable to open and close the door under the transverse door frame in such a way as to generate a circular-arc shaped moving locus, said mechanism comprising:

(a) a toothed drive pulley mounted at one circumferential side end of said transverse door frame and a driven pulley connected to a means for driving said driven pulley mounted at another side end of said transverse door frame;

(b) a toothed endless belt wound between and around said toothed drive pulley and said toothed driven pulley, said toothed endless belt being twisted by an angle of 180 degrees in a vicinity of turning end portions from which, during the movement of said belt by driving of said means for driving, an inner circular-arc shaped portion of said belt is turned into an outer circular-arc shaped portion, while another circular-arc shaped portion of said belt is turned into an inner circular-arc portion so that, over a major part of said outer circular-arc shaped portion, an inner surface of said belt having teeth formed thereon adapted to be originally turned inside is turned outside, while a smooth outer surface thereof adapted to be originally turned outside is turned inside; and (c) inner and outer guide means for guiding said belt being kept in contact with the outer surface of the inner circular-arc shaped portion of said toothed endless belt and the inner surface of the outer circular-arc shaped portion thereof, respectively;

wherein said door body is connected to said toothed endless belt.

8. An opening/closing mechanism for use in a sliding type circular-arc shaped door as claimed in claim 7, wherein said door body comprises a pair of left and right door bodies each having a circular-arc horizontal sectional shape, further comprising:

a pair of left and right guide rails bent in a circular-arc shape concentric with a center of the circular-arc of said transverse door frame, respective circular-arc shapes of said pair of left and right guide rails being concentric with each other, but different from each other in their respective radii, said door bodies being slidably movable in opposite directions relative to one another on said guide rails.

* * * * *